US005887806A

United States Patent [19]

Onken

[11] Patent Number: 5,887,806

[45] Date of Patent: Mar. 30, 1999

[54] SAFETY DEVICE FOR PREVENTING A FIRE IN A SHREDDER MACHINE

[76] Inventor: Donald R. Onken, P.O. Box 72, Easton, Ill. 62633

[21] Appl. No.: 897,674

[22] Filed: Jul. 21, 1997

[51] Int. Cl.[6] ..... B02C 19/00

[52] U.S. Cl. ..... 241/31; 241/79.1

[58] Field of Search ..... 241/31, 24.11, 241/79.1, 78, DIG. 14, 37.5

[56] References Cited

U.S. PATENT DOCUMENTS 2,293,670 8/1942 Sickman ..... 241/31

3,972,481 8/1976 Naporano et al. ..... 241/31

5,022,328 6/1991 Robertson ..... 241/31

*Primary Examiner*—Mark Rosenbaum

*Attorney, Agent, or Firm*—Edwin E. Greigg; Ronald E. Greigg

[57] ABSTRACT

A fire safety device for an outlet of a shredder device. The fire safety device is positioned juxtaposed an exhaust chute and an outlet of the shredder. The fire safety device is operative to force shredded products from the outlet and to close off the exhaust chute to the shredder. The fire safety device prevents oxygen from entering the exhaust chute so that a fire cannot be sustained in the shredder.

10 Claims, 5 Drawing Sheets

SAFETY DEVICE FOR PREVENTING A FIRE IN A SHREDDER MACHINE

BACKGROUND OF THE INVENTION

This invention is directed to a shredder machine and more particularly to a shredder machine having a device for preventing a fire in a shredder used particularly for shredding oil filters.

Heretofore shredding machines have been used for shredding oil filters in which there was a possibility of a fire due to sparks caused by metal pieces in which the sparks were sufficient to set the surface oil on fire. Such a machine is a machine model 3800 manufactured by American Pulverizer Company, 5540 West Park Avenue, St. Louis, Mo. 63110. This machine has a container at ground level in which the oil filters are initially placed. The oil filters are then raised by a conveyor from which the oil filters are dropped into a receiving container. The oil filters are then fed into a shredder which shreds the oil filters to separate the metal pieces from the paper of which the oil filter is made. The shredder reduces the metal and paper to small fragments. In order to insure that all of the metal and paper has been reduced to small fragments, the reduced fragments are then conveyed to a second shredder by use of a conveyor. The fragments are dropped into a second shredder which then insures that the metal and paper are reduced to smaller fragments. The first reduced fragments pass through the second shredder which reduces the metal and paper to small fragments. The smaller fragments fall onto an end of a conveyor at the bottom of the shredder. The smaller metal fragments are separated from the paper fragments by use of a magnet which attracts the metal pieces. The paper fragments are conveyed to a waste paper receptacle and the metal fragments are conveyed to a separate receptacle. In this way, the metal and paper fragments are separated from each other.

While the oil filters are shredded, most of the residual oil will flow to a lower part of the machine into a receptacle to draw out of the first shredder. The oil is then fed away to a receiver where it is reclaimed. Since the oil filter is made of metal parts and paper, some of the oil will be carried along with the fragments and will coat the surfaces of the second shredder. There is a possibility of a fire being initiated in the second shredder; therefore, a fire prevention means has been added to the outlet of the second shredder.

OBJECT AND SUMMARY OF THE INVENTION

It is therefore an object of the invention to provide a means by which a fire can be snuffed in the outlet in sufficient time to prevent the shredder and possibly the building from burning due to a fire in the second shredder.

Another object is to provide a safety device which is simple to manufacture and which is simple to operate.

Still another object is to provide a safety means which cooperates with an outlet chute of the second shredder to prevent a fire in the second shredder.

Yet another object is to provide means in combination with the fire safety means by which paper and metal fragments that drop onto the safety means are scraped off as the fire safety device is moved from a fire prevention position to its normal rest position.

The invention will be better understood and further objects and advantages thereof will become more apparent from the ensuing detailed description of preferred embodiments taken in conjunction with the drawings.

DETAILED DESCRIPTION OF THE PREFERRED EMBODIMENT

Figure 1:
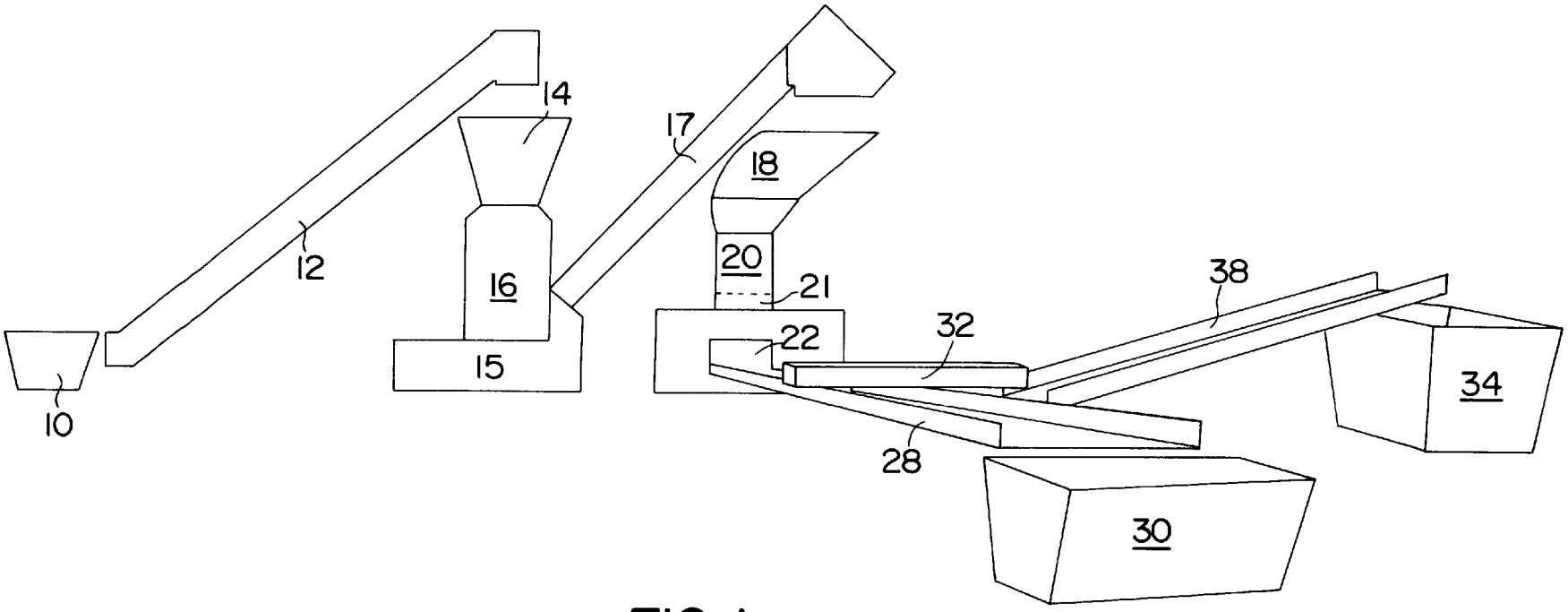
FIG. 1 PRIOR ART
FIG. 1 illustrates a diagrammatic view of a shredder assembly in which the safety device is used.
Figure 2:
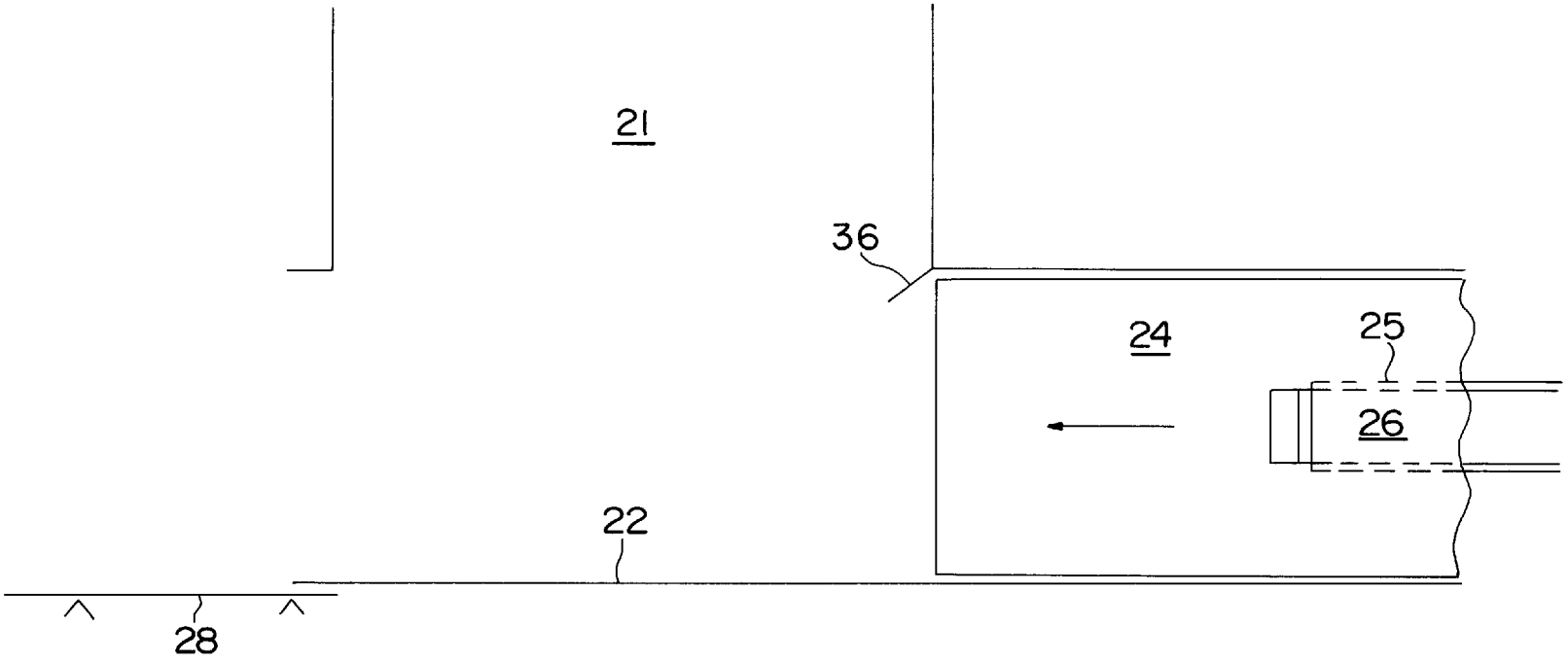
FIG. 2 illustrates a side view of the chute and ram with the ram in a rest position in which the chute is open.
Figure 3:
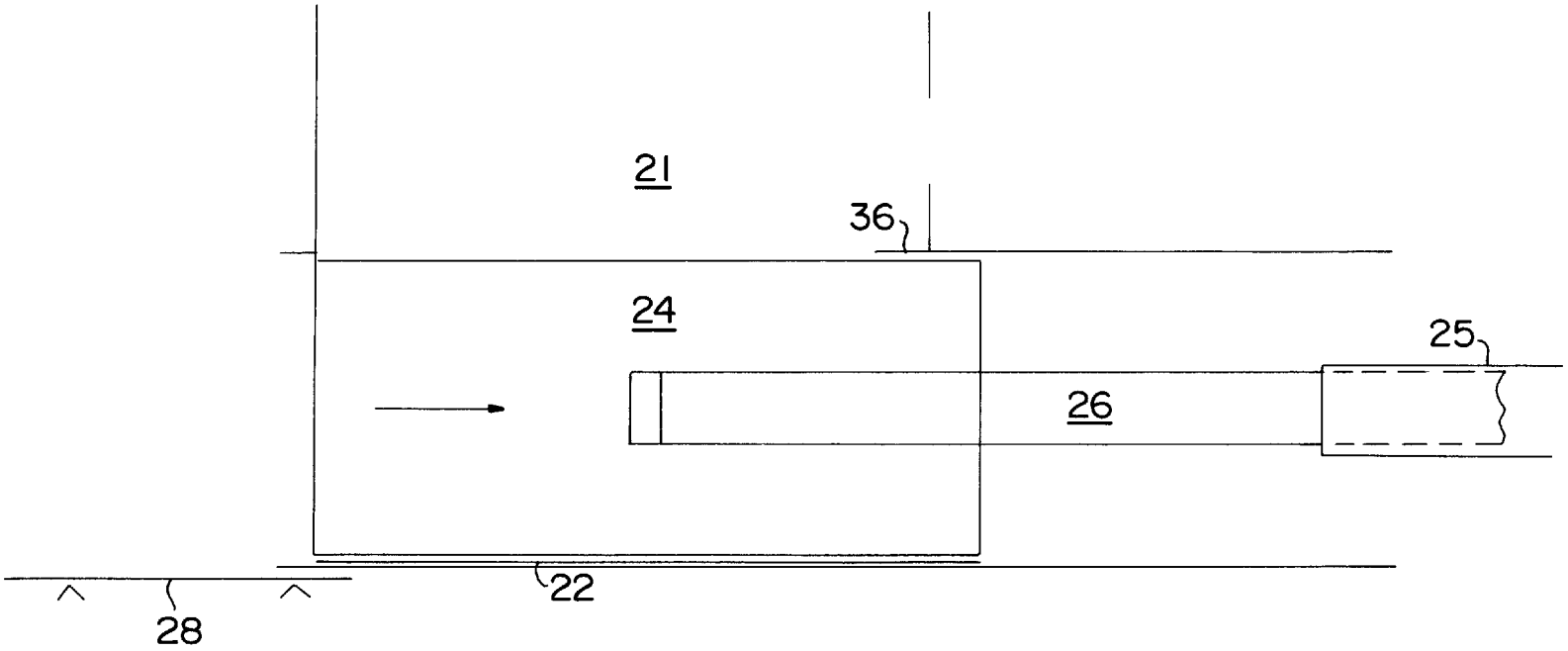
FIG. 3 illustrates the ram in a position that closes off the chute.
Figure 4:
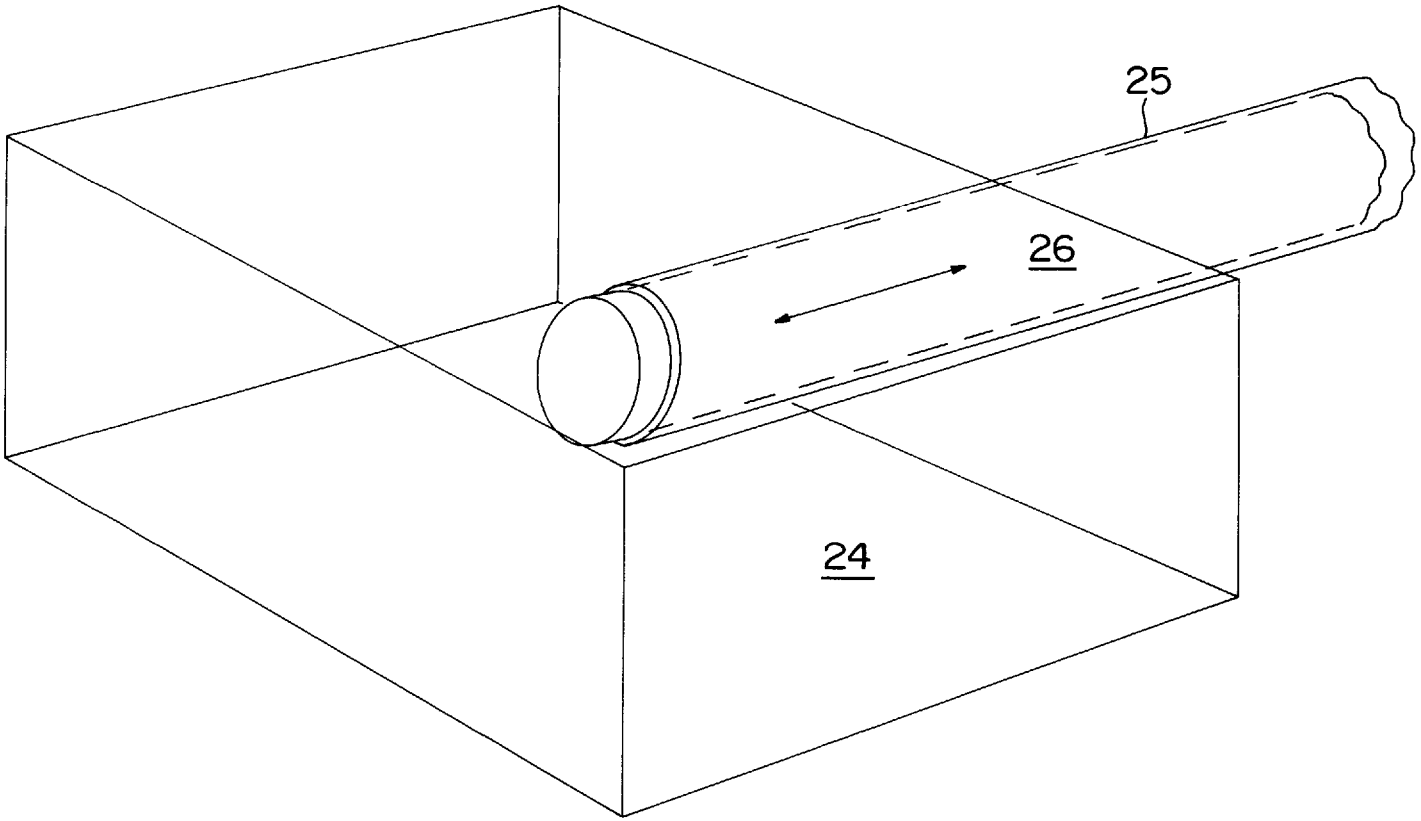
FIG. 4 illustrates a perspective view of the ram to show the rectangular shape.
Figure 5:
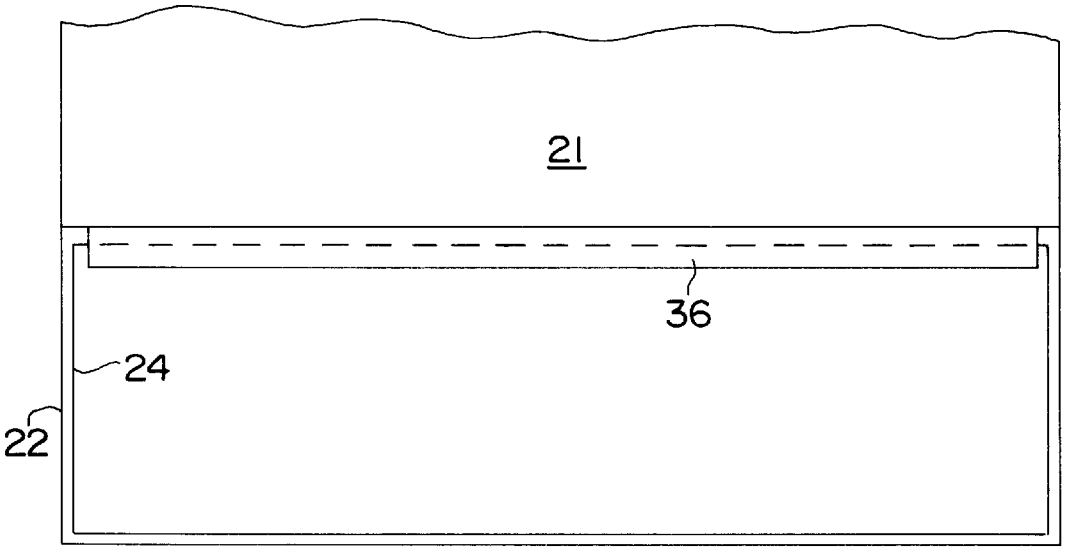
FIG. 5 illustrates a view looking inwardly toward the outlet and toward an inner end of the fire safety device and shows a scraper for scraping off fragments which have fallen onto the top of the fire safety device when it is withdrawn from the outlet.

Now referring to FIG. 1, there is shown a diagrammatic view of the prior art shredder with which a safety means according to the invention is used. As shown, the shredder includes an oil filter loading receptacle 10. Used oil filters are dumped into the receptacle 10 from which they are conveyed by a conveyor 12 to a second oil filter receptacle 14. From the second receptacle 14, the oil filters are moved by gravity and via shredding elements of a first stage shredder 16 to an outlet of the first stage shredder 16. The shredding elements of the first stage reduce the oil filters to metal and paper fragments. These metal and paper fragments are then conveyed from an outlet 15 of the first stage shredder to a second receptacle 18 of a second stage shredder 20 which is provided to insure that all of the metal is reduced in size to small pieces. It has been determined that large oil filters, such as used in large trucks and heavy equipment, are not always completely pulverized into small pieces by one shredder. Therefore, the system has been made to have a second shredder stage by which one is insured that the metal pieces are completely pulverized into small pieces.

This proceeds as follows. The metal and paper fragments of the first stage are conveyed by a conveyor 17 to a receptacle 18 of a second stage. The metal and paper fragments fall by gravity into the shredders of the second stage 20 where, after further pulverization, they fall through an exhaust chute 21 onto a bottom of an outlet 22. It has been determined that a fire can be started in the second shredder 20; therefore, applicant has developed a safety device 24 which is operative to prevent a fire. The safety device 24 is formed as a hydraulic ram. A hydraulic cylinder 25 having a piston 26 having a size of about 6 inches in diameter is secured centrally within the ram which is of rectangular shape, and in the preferred embodiment, it is about 2 feet high by 3 feet wide and over 30 inches long. The hydraulic piston has a movement of about 30 inches which is sufficient to close-off the exhaust chute. The ram is moved from a back side of the shredder toward a front side. In operation, the ram is periodically operated at regular intervals, preferably cycling in and out once per minute. When the ram is moved forward, the ram closes off the exhaust chute so that no oxygen is allowed into the chute from the bottom; therefore, a fire cannot start or if a fire starts in the shredder, the ram can be operated so as to close off the chute. Since the chute is closed off, a fire cannot start or if started it will not burn long without oxygen. As the ram is moved forward periodically, the metal and paper fragments falling into the outlet area will be forced from the outlet onto a vibrating table 28. The vibrating table feeds the metal and paper fragments outwardly to a further machine stage where the metal is separated from the paper. The paper fragments travel via by the shaker table into collection bins 30. In order to separate the metal fragments from the paper fragments, a magnetized belt 32 is mounted over the shaker table so that the metal fragments are collected by the magnetized belt and carried off to a metal fragment receptacle 34 or dropped onto a conveyor 38 which conveys the metal particles to further collection bins 34.

The oil filters have oil in them when they are removed from a vehicle. The oil can be reclaimed before the filters are transported to the shredder. However, any oil that remains in the filters will flow to the bottom of the first shredder and can be reclaimed from a bottom of the first shredder. Further, oil impregnates the paper filter elements processed by the machine, the fragments of which (called "fluff" in the trade) can be reclaimed for their BTU heat content and burned as a fuel. Since the paper fragments have some oil thereon, a spark from the metal pulverization could start a fire in the second shredder. Therefore, applicant has provided the safety means (ram) described above to prevent a fire.

The safety means described hereinabove not only forces the metal and paper fragments from the outlet of the second stage shredder but at the same time closes off the outlet chute to prevent a fire. A scrapper blade 36 has been provided above the ram along the bottom edge of the chute 21 in order to scrape off any metal and paper fragments that may have fallen onto the upper surface of the ram. The metal and paper fragments that may fall onto the top of the ram when it is in its forward position closing the chute are scraped off as the ram is moved rearwardly to open the chute.

In operation, used oil filters are dumped into a receptacle, the oil filters are conveyed to a hopper of a first shredder from which the oil filters are directed through the first shredder. The first shredder shreds the oil filters to separate the metal from the paper and metal and paper fragments are passed from the first shredder to an outlet of the first shredder. The metal and paper fragments are conveyed from the exhaust outlet of the first shredder via a conveyor up to a hopper for a second shredder. The metal and paper fragments pass into a second shredder which shreds the metal and paper to more finely pulverize the metal and thus reduce the size of the metallic pieces. The metal and paper fragments drop through a chute of the second shredder into an outlet area. A fire safety ram juxtaposed the chute of the second shredder is periodically moved from an area juxtaposed to the chute to a position sealing the chute. In moving across the outlet the ram closes off the chute from passage of any oxygen and simultaneously forces the metal and paper fragments from the outlet of the second shredder onto a shaker table. This shaker table conveys the metal and paper fragments outwardly from the machine to a point where the metal is separated from the paper. A magnetic means attracts the metal which is conveyed to a receptacle for collecting the metal fragments. The paper is moved along the shaker to a receptacle for receiving the paper fragments. The operation is continuous with the ram being forced cross the chute at regular intervals, such as once every minute, and then returned to its rest position. If there is a fire in the chute, the ram can be actuated to travel quickly through the outlet area and across the chute to close off the chute. By closing off the chute, the fire will be snuffed out due to a lack of oxygen. Thus, it is clear that the ram is operational to periodically move the metal and paper fragments from the outlet of the second shredder and to close off the chute to prevent a fire.

In another embodiment, the machine could consist of a single shredder stage with the safety ram mounted in an outlet area of that single stage so as to effectuate fire reduction in a single stage machine. Such a single stage processing could work reasonably well if no truck oil filters were being shredded or one were satisfied with larger metallic pieces being produced by this process.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. In combination, a product shredder including at least one shredder stage, at least one exhaust chute for said at least one shredder stage, at least one conveyor that conveys the product from at least one receiving receptacle to at least one hopper of said at least one shredder stage, and an outlet relative to said at least one exhaust chute, a fire safety means which is moved linearly relative to said at least one chute, said fire safety means has a closed end in a direction of said outlet when in a rest position and is of a size and configuration which fills said outlet relative to said at least one chute when said fire safety means is moved in a linear direction to close off said at least one chute, said fire safety means is operative periodically to close said at least one chute from a chute open position to a chute closed position simultaneously forcing a shredded product from said outlet onto a vibrating shaker table which aids in separating metal fragments from paper fragments, and in said chute closed position, said fire safety device seals off said at least one chute to prevent any oxygen from entering said at least one chute, whereby a fire can be prevented.

2. A combination as set forth in claim 1, in which said fire safety means is rectangular in shape with a closed end in a direction of said outlet when in a rest position.

3. A combination as set forth in claim 1, which includes one shredder, one conveyor to convey products to be shredded to a hopper of said shredder, one exhaust chute, and one outlet.

4. A combination as set forth in claim 1, which includes a first shredder, a conveyor that conveys a product to be shredded to a first hopper for said first shredder, said first shredder includes an outlet for shredded products, a second shredder, a second conveyor that conveys shredded product fragments from said outlet of said first shredder to a hopper of said second shredder, said second shredder including an exhaust chute and an outlet, and said fire safety means is positioned relative to said outlet and said exhaust chute of said second shredder.

5. A combination as set forth in claim 4, which includes a magnetic means for separating metal fragments from paper fragments.

6. A combination as set forth in claim 3, which includes a magnetic means for separating metal fragments from paper fragments.

7. In combination, a product shredder including at least one shredder stage, at least one exhaust chute for said at least one shredder stage, at least one conveyor that conveys the product from at least one receiving receptacle to at least one hopper of said at least one shredder stage, and an outlet relative to said at least one exhaust chute, a fire safety means, said fire safety means having a rest position juxtaposed said at least one outlet, said fire safety means is reciprocated to move relative to said at least one exhaust chute from said rest position to a second position in a linear direction to close off said at least one exhaust chute, said fire safety means is of a size and configuration to fill said outlet relative to said at least one chute when moved to close off said at least one chute, whereby air can be excluded from the at least one shredder stage to prevent fires, and a scrapper means is secured along an edge of said at least one outlet chute which is near an inner end of said fire safety means and relative to an upper surface of said fire safety means when said fire safety means is in a rest position.

8. A combination as set forth in claim 7, in which said fire safety means is operative periodically to force a shredded product from said outlet onto a vibrating shaker table which aids in separating metal fragments from paper fragments.

9. In combination, a product shredder including at least one shredder stage, at least one exhaust chute for said at least one shredder stage, at least one conveyor that conveys the product from at least one receiving receptacle to at least one hopper of said at least one shredder stage, and an outlet relative to said at least one exhaust chute, a fire safety means, said fire safety means having a rest position juxtaposed said at least one outlet, said fire safety means is reciprocated to move relative to said at least one exhaust chute from said rest position to a second position in a linear direction to close off said at least one exhaust chute, said fire safety means is of a size and configuration to fill said outlet relative to said at least one chute when moved to close off said at least one chute, whereby air can be excluded from the at least one shredder stage to prevent fires.

10. A combination as set forth in claim 9, in which said fire safety means is operative periodically to force a shredded product from said outlet onto a vibrating shaker table which aids in separating metal fragments from paper fragments.

* * * * *